US007780468B1

(12) United States Patent
Bishop

(10) Patent No.: US 7,780,468 B1
(45) Date of Patent: Aug. 24, 2010

(54) WIRE TO BOARD CONNECTOR

(75) Inventor: Peter Bishop, Cambridgeshire (GB)

(73) Assignee: Avx Corporation, Myrtle Beach, SC (US)

( * ) Notice: Subject to any disclaimer, the term of this patent is extended or adjusted under 35 U.S.C. 154(b) by 0 days.

(21) Appl. No.: 12/487,341

(22) Filed: Jun. 18, 2009

(51) Int. Cl.
*H01R 11/20* (2006.01)
*H01R 4/24* (2006.01)

(52) U.S. Cl. ..... 439/441; 439/66

(58) Field of Classification Search ..... 439/65, 439/66, 441, 79, 80, 74
See application file for complete search history.

(56) References Cited

U.S. PATENT DOCUMENTS 5,967,800 A * 10/1999 Bishop ..... 439/74
6,050,845 A 4/2000 Smalley, Jr. et al.
6,077,089 A 6/2000 Bishop et al.
7,320,616 B1 1/2008 Legrady et al.

* cited by examiner

*Primary Examiner*—Javaid Nasri
(74) *Attorney, Agent, or Firm*—Dority & Manning, P.A.

(57) ABSTRACT

An electrical connector for connecting wires to components includes an insulative body member having a longitudinally extending leg defined between opposite longitudinal ends. A plurality of spaced apart side walls define adjacently disposed connector positions along the leg. A wire insertion opening is defined in a front wall of the body member at each of the connector positions. A connector element is disposed transverse to the leg at each of the connector positions. The connector element includes a first resilient contact arm extending above the side walls for pressing mating contact with a conductive pad of a separate respective component. The connector element includes a second resilient contact arm in biased engagement against a shoulder of the body member. Upon insertion of an exposed conductive wire core through the wire insertion opening, the wire core causes the second resilient contact arm to flex towards and remain in biased electrical contact engagement against the wire core.

20 Claims, 4 Drawing Sheets

WIRE TO BOARD CONNECTOR

FIELD OF THE INVENTION

The present invention relates generally to the field of electrical connectors, and more particularly to type of connector used to connect one or more insulated wires to a component, such as a printed circuit board (PCB).

BACKGROUND

Various types of connectors are known in the art for forming connections between an insulated wire and any manner of electronic component. These connectors are typically available as sockets, plugs, and shrouded headers in a vast range of sizes, pitches, and plating options. Many of these conventional connectors are referred to as Insulation Displacement Connectors (IDC) in that they include one or more contact elements incorporating a set of blades or jaws that cut through the insulation around the wire and make electrical contact with the conductive core in a one-step process, thus eliminating the need for wire stripping and crimping, or other wire preparation. IDCs are used extensively in the telecommunications industry, and are becoming more widely used in printed circuit board (PCB) applications.

AVX Corporation of Myrtle Beach, S.C., USA, offers a line of low profile IDC wire to board connectors (Series 9175-9177) that are SMT (surface mount technology) mounted to a circuit board prior to insertion of wires into contact slots with the aid of a hand tool. This process cuts the wire insulation and enables the conductive wire cores to form a secure conductive joint with the connector.

U.S. Pat. No. 6,050,845 describes an IDC assembly that can be mounted to a circuit board and secured thereto prior to terminating conductors to the connector. The electrical connector includes a housing having at least one conductor-receiving aperture and an associated terminal-receiving passageway extending from a board mounting face and intersecting each conductor-receiving aperture. A terminal is disposed in each terminal-receiving passageway and includes a body portion having a first connecting section extending from one end adapted to be inserted in a through-hole of a circuit board, and a pair of upstanding arms defining an IDC slot for receipt of a wire. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the board to a second position against the board and simultaneously pushing all the corresponding wires into respective IDC slots.

Various attempts have been made to configure IDCs for surface mounting technology (SMT) applications as well. For example, U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes. An insulated conductor, such as a wire, cable and/or ribbon, is inserted in a channel in the main body without being pierced by the piercing end of the contact. When a user pushes down on the top portion of the main body, the contact slides into the channel and pierces the insulated conductor. The top portion of the main body also provides a surface for a vacuum pick-up nozzle in an automated pick-and-place assembly process.

IDC wire to board connectors are not suited for all applications wherein it is desired to connect one or more wires to a component. For example, the IDCs in the above cited references are relatively complicated in that they require all or a portion of the main body to be movable or slidable relative to the contacts to make final connection with the wires after ends of the contacts have been inserted into through holes in the PCB or surface mounted to the PCB. In addition, a perception to some in the industry is that IDCs are not well suited for stressful environments wherein the electrical component is subjected to prolonged shock and vibrations because the wires tend to move or pull out of the contact blades.

The present invention provides an alternative to IDC wire to board connectors that is rugged, reliable, and not dependent on SMT applications.

SUMMARY

Objects and advantages of the invention will be set forth in part in the following description, or may be obvious from the description, or may be learned through practice of the invention.

In accordance with aspects of the invention, an electrical connector is provided that is particularly well suited for connecting one or more insulated conductive core wires to an electrical component, such as a PCB. It should be appreciated that connectors according to the invention are not limited to use with boards, but may used in any application wherein a secure electrical connection is desired between wires and any other type of component. The connectors will be described herein as used to connect wires to boards for illustrative purposes only.

The connector includes an elongated body member (also referred to in the art as a "molding") formed from any conventional insulator material. The body member can take on various shapes and sizes, but generally includes a bottom wall, a front wall, longitudinal end walls, and a longitudinally extending leg defined between the end walls. A plurality of spaced apart side walls are disposed transverse to the leg and define a plurality of adjacently disposed spaced apart connector positions along the leg between the longitudinal ends of the body member. Any number of desired connector positions may be included in a single connector.

A wire insertion opening is defined in a wall of the body member at each of the connector positions. This opening is sized for receipt of the conductive core member of a particular gauge wire. Depending on the orientation of the body member, the wire insertion opening may be considered to be defined in a front wall of the body member, or a bottom wall, and so forth.

A connector element is disposed transverse to the leg at each of the connector positions. Each of the connector elements includes a first closed end wrapped around an edge of the leg, and a first resilient contact arm extending from the first closed end and angled away from the leg so as to extend above the side walls. The resilient contact arm includes an outwardly facing contact surface for pressing mating contact with a conductive pad of a separate respective electrical component. The connector element further includes a transverse portion that extends from the first closed end along and engaged against the leg.

The transverse portion extends to a second closed end of the connector element, and a second resilient contact arm extending from this second closed end at an angle away from the transverse portion and towards the first closed end. The second resilient contact arm is in biased engagement against a shoulder of the body member and includes a contact surface that extends into a wire receipt chamber defined at the respective connector position below the leg member. With this configuration, upon insertion of an exposed conductive wire core through the wire insertion opening and into the wire receipt chamber, the wire core causes the second resilient contact arm to flex towards the transverse portion while remaining in biased electrical contact engagement against the wire core. This biased contact also serves to ensure that the wire is securely retained in the opening, particularly in the case wherein the edge of the second resilient contact arm "bites" the exposed wire core, making it difficult to pull the wire core out of the opening.

In a particular embodiment, the body side walls define an uppermost plane of the body member, and an open (at the top end) recess is defined at each connector position for the first resilient contact arm between adjacent side walls, wherein the first resilient arms are pressed into these recesses upon engagement with the separate respective electrical component.

The body member may include a bottom wall extending transverse from the front wall. In this embodiment, the wire receipt chamber may be enclosed and defined between the transverse portion of the connector element and the bottom wall. In an alternate embodiment, the wire receipt chamber may be only partially enclosed by structure of the body member, for example between lower side wall portions that extend below the leg member.

The connector elements may be retained at the connector positions by any suitable means. For example, the connector elements may be press-fitted into said body member at each connector position. Any manner of retaining structure may be provided at the connector positions to ensure that the connector elements remain secured relative to the body member. For example, any combination of pinch points, grooves, ledges, barbs, pressure bumps, and so forth, may be molded into the body member, particularly in the side walls, at each connector position for this purpose. The connector elements may also include any manner or retaining structure that engages with the body member. For example, barbs, bumps, and the like, may be incorporated at any location on the connector elements for this purpose.

In a unique embodiment, the body member may further include a top wall that extends above the connector positions and defines a component slot for insertion of an edge or extension of the respective electrical component for mating contact with the first resilient contact arms. This slot may extend between longitudinal end side walls of the body member. The slot may be sized so that the edge or extension of the electrical component is press fitted into the slot without the need of additional retaining means to secure the component to the connector body.

In still another embodiment, the body member may include an extension wall that extends transversely from the front wall at a location adjacent to the wire insertion openings. This extension wall may include a clamping surface for a wire harness device that can be used to secure or retain the plurality wires that are in electrical contact with the connector engaged against the body member.

The connector may be attachable to a circuit board or other component by any suitable means. For example, the body member may include any manner of male or female structure that engages with complimentary female or male structure of the board. In particular embodiments, male structure such as protruding members may be included at any position on the body member that engage in holes or recesses in the board to securely retain the board in position relative to the connector. It should be appreciated that any manner of mounting technology may be incorporated with connectors and component assemblies in accordance with the invention.

The present invention also encompasses any manner of electrical component assembly that incorporates the unique connector element to electrically connect a plurality of wires to an electrical component. For example, the component assembly may include a PCB in electrical mating contact with a plurality of conductive wires via the electrical connector. The connectors are particularly well suited for connecting a plurality of wires to an LED board in a light fixture, or any other type of LED application.

Particular embodiments of the unique insulation displacement connectors are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

An exemplary embodiment of an electrical connector 10 according to aspects of the invention is illustrated in FIGS. 1 through 4. The electrical connector 10 is configured for connecting the conductive core of one or more insulated wires to any manner of electrical component, such as a PCB. For ease of explanation and illustration, the connector 10 is illustrated and referred to herein in the context of connecting wires to a board, such as a PCB or an LED board.

Figure 1:
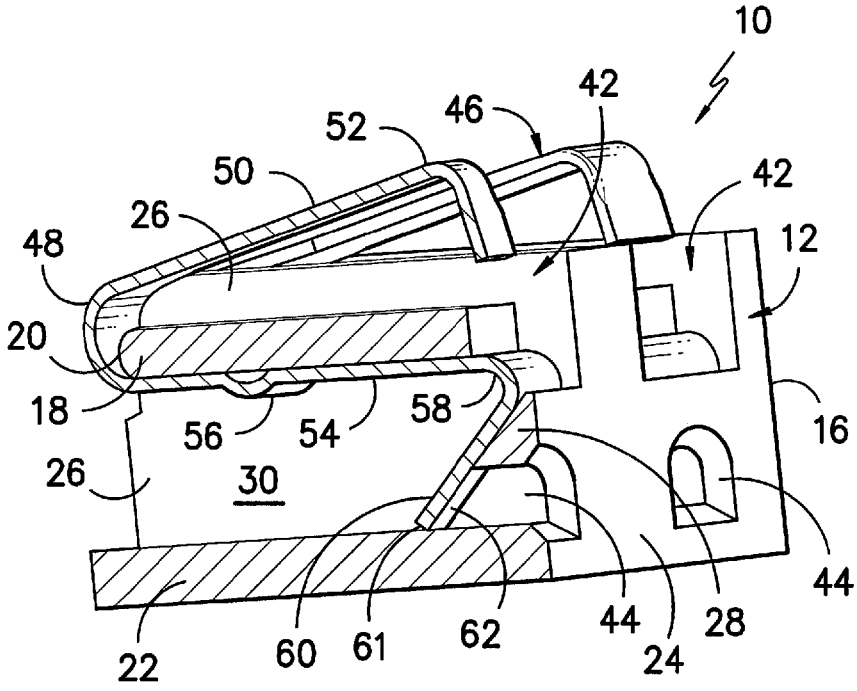
FIG. 1 is a perspective view of an embodiment of a connector according to aspects of the invention.
Figure 2:
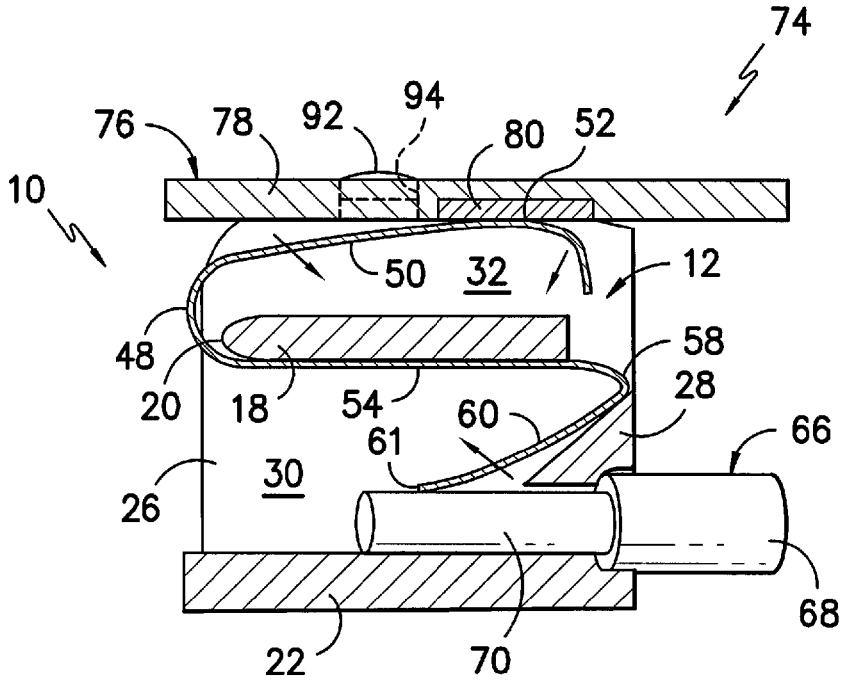
FIG. 2 is a side cut-away view showing the connector embodiment of FIG. 1 in mating electrical contact with a board and a wire.
Figure 3:
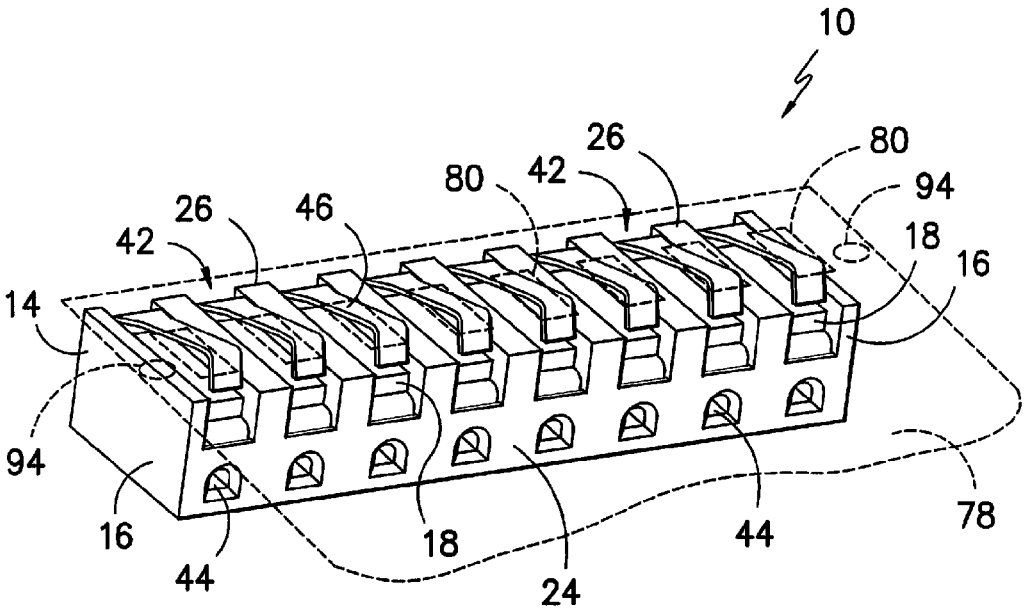
FIG. 3 is a perspective top and front side view of a multiple wire connector in accordance with aspects of the invention.

Referring particularly to FIGS. 1 and 2, the connector 10 includes an elongated body member 12 formed from any conventional insulator material, for example a high temperature plastic material such as STANYL high temperature resistant nylon. The body member 12 can take on various shapes and sizes depending on its intended use, but generally includes a bottom wall 22, longitudinal end walls 16, and a longitudinally extending leg 18 defined between the end walls 16. A plurality of spaced apart side walls 26 are disposed transverse to the leg 18 and define a plurality of adjacently disposed and spaced apart connector positions 42 along the longitudinal length of the leg 18 between the end walls 16. It should be readily appreciated that any number of desired connector positions 42 may be included in a single connector 10. For example, in the embodiment illustrated in FIGS. 3 and 4, the connector 10 is configured as an 8-way connector for mating up to eight wires to an electrical component.

Still referring to FIGS. 1 and 2, wire insertion openings 44 are defined in a wall of the body member 12, such as a front wall 24, and are configured for receipt of the conductive core member 70 of a particular gauge wire 66. The openings 44 allow the conductive core 70 at a stripped end portion of the wire 66 to be inserted into the opening but, desirably, prevent the insulation portion 68 of the wire 66 from fitting through the opening 44, as illustrated in FIG. 2.

A connector element 46 is disposed transverse to the leg 18 at each of the connector positions 42. The connector elements 46 may be formed from any conventional conducting material, for example a conventional copper alloy material having any desired thickness. Each of the connector elements 46 includes a first closed end 48 defined by a generally U-shaped bent portion of the connector element 46. The first closed end 48 wraps around an edge 20 of the leg 18, as particularly illustrated in FIG. 1. A first resilient contact arm 50 extends at an angle from the first closed end 48 of the contact element. In the illustrated embodiment, the first resilient contact arm 50 extends over and forms an acute angle with the transverse leg 18 of the body member 12. The resilient contact arm 50 includes an outwardly facing contact surface 52 generally towards the end of the arm 50. As particularly illustrated in FIG. 1, the resilient arm 50 and contact surface 52 extend above a top plane of the side walls 26 and end walls 16 of the body member 12. The contact surfaces 52 are designed for pressing, mating contact with a conductive pad of a separate respective electrical component. For example, FIG. 2 is an illustration of a component assembly 74 wherein an electrical component 76, in particular a PCB 78, is engaged in electrical mating contact with the connector 10. In particular, the board 78 includes a footprint of contact pads 80, with an individual contact pad 80 pressed in mating contact against the contact surface 52 of a respective resilient contact arm 50 at each connector position 42. FIG. 2 will be discussed in greater detail below.

Each connector element 46 further includes a transverse portion 54 that extends from the first closed end 48. The transverse portion 54 extends along and is engaged against the leg 18 of the body member 12. The transverse portion 54 extends to a second closed end 58 of the connector element 46, which is formed by a different U-shaped bend in the connector element. A second resilient contact arm 60 extends from the second closed end 58 and is biased against a shoulder component 28 of the body member 12. The second resilient contact arm 60 includes an outwardly facing contact surface 62 that extends into a wire receipt chamber 30 defined at the respective connector position 42, for example below the leg member 18. The contact arm 60 terminates at an edge 61. Referring to FIG. 2, with this unique configuration of the connector element 10, the conductive core 70 of the wire 66 is inserted through the wire insertion opening 44 such that the core 70 presses against the contact surface 62 of the second resilient contact arm 60 and causes the arm 60 to flex into the wire receipt chamber 30. The bias of the contact arm 60, and particularly the edge 61, against the conductive core 70 ensures that electrical contact is maintained between the contact surface 62 and the exposed surface of the conductive core 70, as particularly illustrated in FIG. 2. This engagement also ensures that the wire core 70 is retained in the opening 44, particularly when the edge 61 tends to "bite" into the core 70.

In the embodiments illustrated in FIGS. 1 through 4, the body side walls 26 define an uppermost plane of the body member 12 and are open at the top end. A recess 32 is defined at each connector position 42 for receipt of the first resilient contact arm 50. The recess is defined between adjacent side walls 26 and has a floor or bottom surface defined by the upper surface of the leg member 18. Referring to FIG. 2, when the electrical component 76 is pressed into mating contact with the connector 10, the component 76 engages against the upper surface of the sides 26 and end walls 16 of the body member 12. The first resilient contact arms 50 engage against the contact pad 80 of the component 76 and are flexed into the recess 32, as particularly illustrated by the arrows in FIG. 2.

Figure 4:
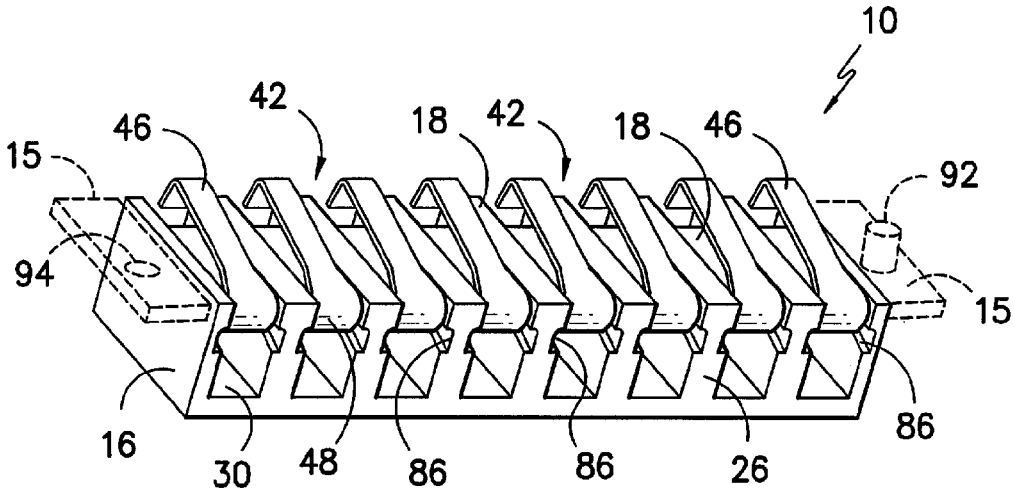
FIG. 4 is a perspective top and back side view of the connector embodiment of FIG. 3.
Figure 5:
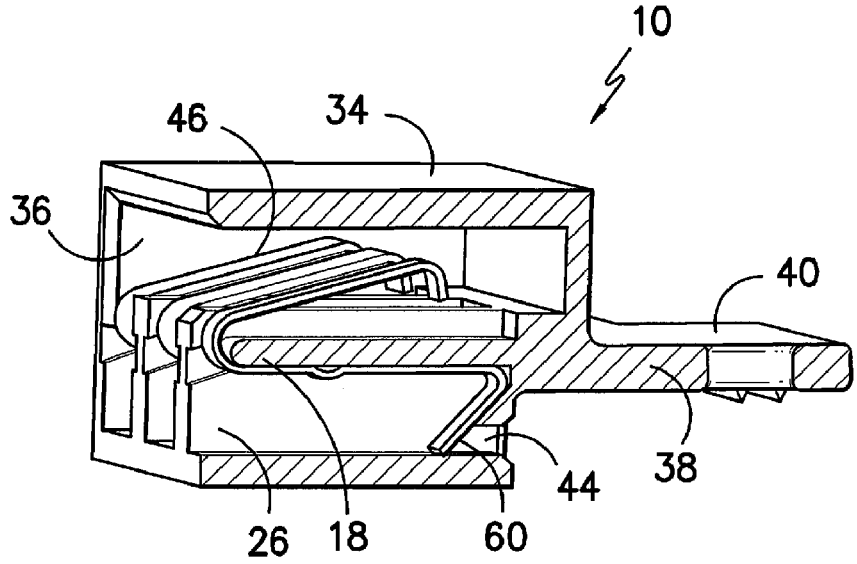
FIG. 5 is a perspective partial cutaway side view of an alternative embodiment of a wire connector in accordance with aspects of the invention.
Figure 6:
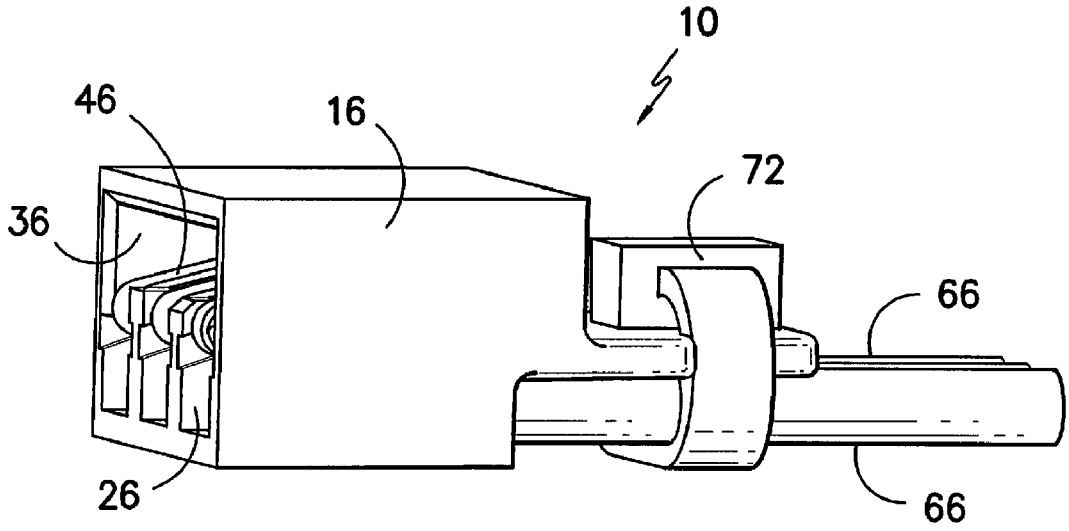
FIG. 6 is a perspective view of the connector embodiment of FIG. 5 mated with a plurality of wires.

In the illustrated embodiment, the body member 12 includes bottom wall 22 extending transverse from the front wall 24. The wire receipt chamber 30 in this particular embodiment is a partially enclosed space defined between the transverse leg 18 and the bottom wall 22, as particularly illustrated in FIGS. 1 and 2. As illustrated in FIG. 4, the wire receipt chamber 30 may be open at the back side of the body member 12. In an alternate embodiment, a back wall 40 of the body member 12 may enclose the back end of the space 30. In still another embodiment, the wire receipt chamber 30 may also be open at the lower end. For example, the bottom wall 22 may not be necessary in certain embodiments of the connector 10 so that the chamber 30 is open at the bottom of the body 12.

The individual connector elements 46 may be retained at the respective connector positions 42 by any suitable means. For example, the connector elements 46 may be press-fitted into the body member 12 at each connector position 42. Any manner of engaging retaining structure may be provided at the respective connector positions for this purpose. For example, as particularly seen in FIG. 4, grooves 86 may be defined in the side walls 26 for receipt of the transverse portion 54 of the connector elements 46. Referring to FIG. 1, a pressure bump 56, or similar engaging structure, may be provided on the transverse portion 54 that ensures a secure press fit of the transverse section 54 within the grooves 86. The structure 56 may, in an alternative embodiment, be a barb, or other like structure. Referring to FIG. 4, it can be seen that the first closed ends 48 of the respective connector elements 46 may have a wider width at the closed ends such that the elements frictionally engage against the side walls 26 in this area. It should be readily appreciated that any combination of pinch points, grooves, ledges, barbs, friction fits, and so forth may be molded into the body member 12 to ensure a secure press fit of the connector elements 46 at each connector position 42.

Any manner of engagement structure may be provided on the body member 12 to secure the connector 10 to a board or other component. For example, such structure may include male members 92 provided on the body member 12 that engage in female members 94 provided on the board or other component, as illustrated for example in the dashed line structure of FIGS. 2, 3, and 4. In the alternative the female members 94, such as holes or recesses, may be provided on the body member 12 that engage with male members 92, such as protruding nubs or like structure, on the board or other component. In the embodiment of FIG. 4, body member extensions 15 include a female member 94 at one end wall 16, and a male member 92 at the opposite end wall. These structures mate with complimentary male and female structure, respectively, on a board 78 (FIG. 3) such that the contact pads 80 are held in electrical engagement with the contact surfaces 52 of the first resilient contact arms 50.

A particularly unique embodiment of a connector 10 is illustrated in FIGS. 5 through 8. In this particular embodiment, the body member 12 includes a top wall 34 that extends longitudinally between the end walls 16 of the body member 12 above the connector positions 42. The top wall 34 defines a component slot 36 above the first resilient contact arms 50 along the longitudinal length of the connector 10. The component slot 36 is configured for receipt of an edge or extension portion of an electrical component, as particularly illustrated in FIGS. 7 and 8. The edge or extension includes contact pads 80 that engage against the first resilient contact arms 50 upon insertion of the extension or edge into the slot 36. Engagement of the edge or extension of the component 76 within the slot 36 may be all that is necessary to ensure positive seated engagement between the components. In this manner, the electrical component 76 is readily disengaged from the connector 10 if desired.

FIGS. 5 through 8 illustrate a further feature of an alternative embodiment of a connector 10 in the form of an extension wall 38. Wall 38 is particularly configured for providing support and retention of a plurality of wires 66 that are engaged with the connector 10. In this regard, the extension wall 38 may include a clamping surface 40 for receipt of a wire harness 72 that clamps around the plurality of wires 66 and secures the wires relatively to the extension wall 38. The harness 72 may be any manner of clamping device that wraps around the wires 66 and the extension wall 38, such as a conventional cable tie as particularly illustrated in FIGS. 7 and 8.

Figure 7:
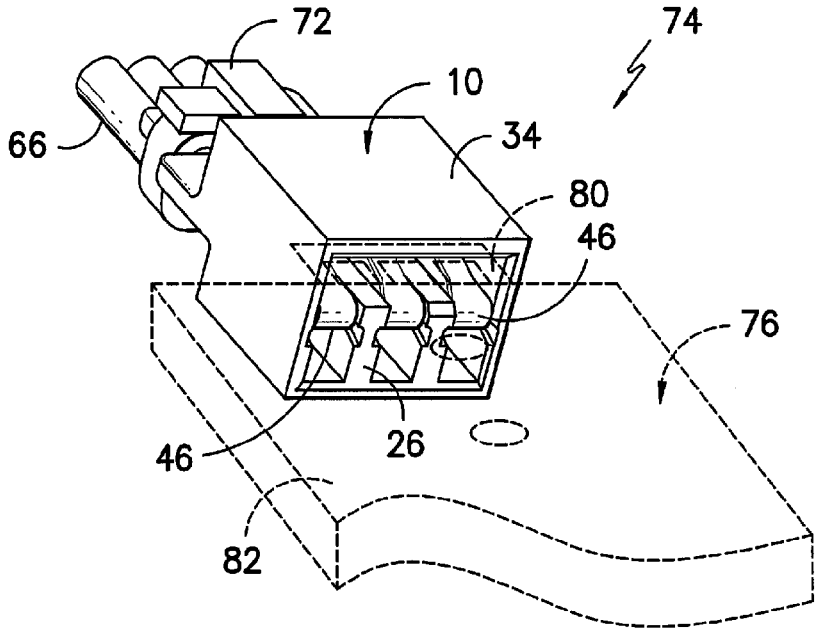
FIG. 7 is a perspective view of an electrical component assembly utilizing the wire connector embodiment of FIG. 6.
Figure 8:
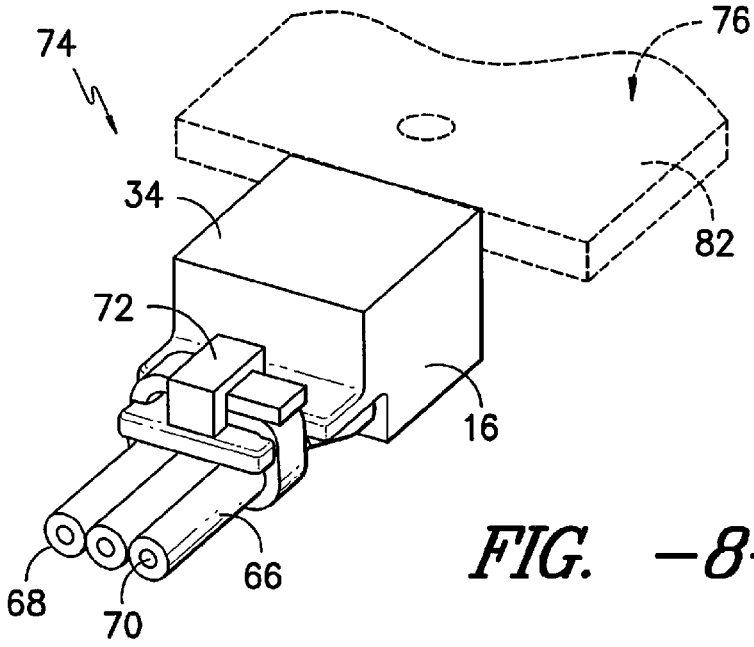
FIG. 8 is an alternate perspective view of the electrical component assembly of FIG. 7.

As previously mentioned, the present invention also encompasses any manner of electrical component assembly that incorporates the unique connector 10 of the present invention to electrically connect a plurality of wires to an electrical component. This concept is illustrated in FIGS. 2, 7 and 8 wherein a component assembly 74 is illustrated. As discussed, in FIG. 2, the component assembly 74 includes an electrical component 76 in the form of a PCB 78. In the embodiment illustrated in FIGS. 7 and 8, the component assembly includes an electrical component 76 in the form of an LED board 82. The connectors 10 are particularly well suited for connecting a plurality of wires to an LED board 82 in a light fixture or any other type of LED application. It should be readily appreciated that the component assembly 74 is not limited by any particular type of electrical component 76.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. An electrical connector configured for connecting wires to components, said connector comprising:

an insulative body member having a longitudinally extending leg defined between opposite longitudinal ends, and a plurality of adjacently disposed spaced apart connector positions along said leg between said longitudinal ends;

a wire insertion opening defined in a wall of said body member at each of said connector positions;

a connector element disposed transverse to said leg at each of said connector positions, said connector element comprising a first closed end wrapped around an edge of said leg, and a first resilient contact arm extending from said first closed end and angled away from said leg so as to extend above said leg, said resilient contact arm comprising an outwardly facing contact surface for pressing mating contact with a conductive pad of a separate respective component;

said connector element further comprising a transverse portion extending from said first closed end along said leg to a second closed end of said connector element;

a second resilient contact arm extending from said second closed end and angled away from said transverse portion towards said first closed end, said second resilient contact arm in biased engagement against a shoulder of said body member and comprising a contact surface; and wherein upon insertion of an exposed conductive wire core through said wire insertion opening, the wire core causes said second resilient contact arm to flex towards said transverse portion while remaining in biased electrical contact engagement against the wire core.

2. The connector as in claim 1, wherein said plurality of connector positions are defined by a plurality of transverse side walls, said side walls defining an uppermost plane of said body member, and further comprising a recess for said first resilient contact arm between adjacent said side walls and above said leg at each said connector position wherein said first resilient arms are pressed into said recesses upon engagement with the separate respective component.

3. The connector as in claim 2, wherein said connector elements are press-fitted to said body member at each said connector position.

4. The connector as in claim 3, comprising retaining structure at each said connector position that engages and retains said press-fitted connector elements in position at said connector positions.

5. The connector as in claim 4, wherein said retaining structure is defined in said side walls.

6. The connector as in claim 1, wherein said body member comprises a bottom wall extending transverse from said front wall, and a wire receipt chamber defined between said transverse portion of said connector element and said bottom wall, wherein the conductive wire core inserted through said wire insertion opening extends into said wire receipt chamber.

7. The connector as in claim 1, wherein each of said connector positions is open at a top thereof.

8. The connector as in claim 1, wherein said body member further comprises a top wall that extends above said connector positions and defines a component slot for insertion of the respective separate component for mating contact with said first resilient contact arms, said slot extending between longitudinal end side walls of said body member.

9. The connector as in claim 1, wherein said body member further comprises an extension wall adjacent said wire insertion openings, said extension wall defining a clamping surface for a wire harness device.

10. The connector as in claim 9, further comprising a wire harness device that engages said extension wall at said clamping surface, said wire harness device configured to retain the plurality of wires in electrical contact with said connector engaged against said body member.

11. An electrical component assembly, comprising:

an electrical component having a contact pad footprint defined thereon;

a plurality of wires;

an electrical connector maintaining each of said wires in electrical mating contact with a respective said contact pad, wherein said electrical connector comprises:

an insulative body member having a longitudinally extending leg defined between opposite longitudinal ends, and a plurality of spaced apart side walls transverse to said leg, said side walls defining adjacently disposed spaced apart connector positions along said leg between said longitudinal ends;

a wire insertion opening defined in a front wall of said body member at each of said connector positions;

a connector element disposed transverse to said leg at each of said connector positions, said connector element comprising a first closed end wrapped around an edge of said leg;

said connector element further comprising a first resilient contact arm extending from said first closed end and angled away from said leg so as to extend above said side walls, said resilient contact arm comprising an outwardly facing contact surface for pressing mating contact with a respective said contact pad of said electrical component;

said connector element further comprising a transverse portion extending from said first closed end along and engaged against said leg, said transverse portion extending to a second closed end of said connector element;

a second resilient contact arm extending from said second closed end and angled away from said transverse portion towards said first closed end, said second resilient contact arm in biased engagement against a shoulder of said body member and comprising a contact surface extending into a wire receipt chamber defined at said connector position below said leg member; and wherein upon insertion of an exposed conductive wire core of one said wires through said wire insertion opening and into said wire receipt chamber, said wire core causes said second resilient contact arm to flex towards said transverse portion while remaining in biased electrical contact engagement against said wire core.

12. The electrical component assembly as in claim 11, wherein said side walls define an uppermost plane of said body member, and further comprising a recess for said first resilient contact arm between adjacent said side walls and above said leg at each said connector position wherein said first resilient arms are pressed into said recesses upon engagement with said electrical component.

13. The electrical component assembly as in claim 11, wherein said body member comprises a bottom wall extending transverse from said front wall, said wire receipt chamber defined between said transverse portion of said connector element and said bottom wall.

14. The electrical component assembly as in claim 11, wherein said connector elements are press-fitted to said body member at each said connector position.

15. The electrical component assembly as in claim 14, comprising retaining structure at each said connector position that engages and retains said press-fitted connector elements in position at said connector positions.

16. The electrical component assembly as in claim 11, wherein each of said connector positions is open at a top thereof, said electrical component retained in pressed mating contact against said side walls.

17. The electrical component assembly as in claim 11, wherein said body member further comprises a top wall that extends above said connector positions and defines a component slot for insertion of said electrical component for mating contact with said first resilient contact arms, said slot extending between longitudinal end side walls of said body member.

18. The electrical component assembly as in claim 11, wherein said body member further comprises an extension wall extending transversely from said front wall adjacent said wire insertion openings in said front wall, said extension wall defining a clamping surface, and a wire harness device that engages said extension wall at said clamping surface, said wire harness device configured to retain the plurality of wires in electrical contact with said connector engaged against said body member.

19. The electrical component assembly as in claim 11, wherein said electrical component comprises a PCB.

20. The electrical component assembly as in claim 11, wherein said electrical component comprises a LED board.

* * * * *